United States Patent [19]

Ryan et al.

[11] Patent Number: 4,678,229

[45] Date of Patent: Jul. 7, 1987

[54] RECLINING CHAIR

[75] Inventors: James M. Ryan, New York, N.Y.; Sanford S. Golden, Palm Springs, Calif.; Larry Sliker, Newton, N.J.

[73] Assignees: Henry Dreyfuss Associates, New York, N.Y.; Golden Associates, Palm Springs, Calif.

[21] Appl. No.: 843,575

[22] Filed: Mar. 25, 1986

[51] Int. Cl.[4] ..... A46C 1/02

[52] U.S. Cl. ..... 297/68; 297/433; 248/408

[58] Field of Search ..... 297/68, 88, 433; 248/408, 161, 162.1

[56] References Cited

U.S. PATENT DOCUMENTS

| | | | |
|---|---|---|---|
| D. 181,048 | 9/1958 | Golden | D15/3 |
| D. 182,177 | 2/1958 | Golden | D15/11 |
| D. 182,178 | 2/1958 | Golden | D15/11 |
| D. 182,183 | 5/1958 | Golden et al. | D15/11 |
| 282,095 | 7/1883 | Luburg . | |
| 607,538 | 7/1898 | Bergman | 297/68 |
| 1,989,203 | 1/1935 | Larsen . | |
| 2,028,633 | 1/1936 | Thomas . | |
| 2,306,891 | 12/1942 | McArthur | 248/408 |
| 2,310,346 | 2/1943 | Bell | 248/408 |
| 2,492,268 | 12/1949 | Christie | 297/68 |
| 2,514,447 | 7/1950 | Hendrikson et al. . | |
| 2,834,397 | 5/1958 | Kluglein et al. | 297/68 |
| 2,907,374 | 10/1959 | Glass | 297/88 |
| 2,985,228 | 5/1961 | Golden | 155/177 |
| 3,014,686 | 12/1961 | Golden et al. | 248/382 |
| 3,016,265 | 1/1962 | Cobb | 297/88 |
| 3,232,574 | 2/1966 | Ferro | 248/379 |
| 3,299,886 | 1/1967 | Mikan | 128/71 |
| 3,708,203 | 1/1973 | Banecki et al. | 248/408 |
| 3,873,152 | 3/1975 | Garas | 297/68 |
| 4,092,041 | 5/1978 | Landry et al. | 297/68 |
| 4,411,469 | 10/1983 | Drabert | 297/300 |
| 4,415,135 | 11/1983 | French | 248/162.1 |
| 4,429,917 | 2/1984 | Diffrient | 297/300 |

*Primary Examiner*—Francis K. Zugel

*Attorney, Agent, or Firm*—Morgan & Finnegan

[57] ABSTRACT

A chair, infinitely or incrementally adjustable between an upright seating mode and a full-recline mode, includes a concave seating portion continuous with a convex doubly-extensible leg support portion which combine to form an ergonomicly preferred seating attitude when the chair is in a full recline mode. A synchronous belt drive system extends and retracts the legrest and footrest portions and a passive/active height adjust mechanism is provided. The legrest and footrest portions are retained in a tuck position beneath the seating area of the chair when the chair is in an upright mode. A double extension leg support mechanism is provided for extending the legrest and footrest portions relative to the degree of recline.

4 Claims, 8 Drawing Figures

RECLINING CHAIR

BACKGROUND OF THE INVENTION

The invention pertains to reclining chairs and more particularly to reclining chairs having extending leg supports.

It is, of course, well known to provide recline and mechanisms for effecting recline in a wide variety of seating apparatuses. Examples of reclining chairs can be found in home and office environments, and in such diverse fields such as medicine and the transportation industry.

Although reclining chairs have achieved widespread use in the home, they have not reached their optimal potential, especially in the workplace and other commercial environments.

It has been discovered by Dr. Sanford S. Golden, one of the co-inventors herein, that a particular open angle seating curve in a recline position provides greater relaxation and less stress than is provided in standard upright seating positions and other known reclining positions. Dr. Golden's open angle seating concept will be discussed below with regards to FIG. 1. Prior patents to Dr. Golden, illustrating the open angle seating curve concept (hereinafter the "Golden curve") include U.S. Pat. Nos. De. 181,048 (Dental Chair, 1957), De. 182,177 (Deck Chair, 1958), De. 182,178 (Wheel Chair, 1958), De. 182,813 (Transportation Seat, 1958), U.S. Pat. No. 2,985,228 (Chair Constructions, 1961), and U.S. Pat. No. 3,014,686 (Transportation Chair, 1961). Other curved reclining chairs, not incorporating the Golden curve, may be seen for comparison purposes in the works of Ferro (U.S. Pat. No. 3,232,574 entitled "Adjustable Counterbalancing Structure", 1966) and Mikan (U.S. Pat. No. 3,299,886 entitled "Traction Methods and Apparatus", 1967).

It has not heretofore been publicly known to provide the ergonomicly correct Golden curve to office chairs and the like. To effectively provide an operative Golden curve, leg support function must be provided. However, since much of the work ordinarily performed in an office environment must be done in an upright position, with the seated person's legs dangling vertically or even at an acute angle beneath the seating portion of the chair, the necessary leg supports must not interfere with the seated person's legs when the chair is substantially upright. Although several known chairs provide legrests stowed beneath chair seats (see Luburg, U.S. Pat. No. 282,095 entitled "Reclining Chair" (1883); Larsen, U.S. Pat. No. 1,989,203 entitled "Chair" (1935); and Hendrickson al, U.S. Pat. No. 2,514,447 entitled "Chair and Leg Rest Combination" (1950)) such legrest extension apparatuses were often cumbersome, bulky and ordinarily required manual actuation.

Furthermore, although it is also known to provide reclining means for chairs, including office chairs (see Thomas, U.S. Pat. No. 2,028,633 entitled "Seat" (1936); Drabert et al, U.S. Pat. No. 4,411,469 entitled "Chair Particularly a Data Display Chair" (1983); and Different, U.S. Pat. No. 4,429,917 entitled "Chair" (1984)), such known chairs have not served to reduce stress in the workplace environment.

It is therefore an object of the invention to provide a reclining chair having an ergonomicly preferred seating attitude.

It is a further object of the invention to provide improved mechanisms for effecting chair recline and legrest extension and retraction.

It is a still further object of the invention to provide a reclining chair which provides an ergonomicly preferred seating attitude and is additionally well-suited to the workplace environment.

SUMMARY OF THE INVENTION

These and other objects of the invention are met by providing a chair, operative in an infinite number of positions between a full upright seating position and a full recline seating position, including a back portion, a curved seat portion substantially continuous with the back portion and forming a substantially concave seating curvature therewith, and a leg support portion, including a legrest and a footrest, which is pivotally extendable from the forward edge of the seat portion and which, when extended, forms a substantially continuous convex curve with the seat portion. Dual-pivoting reclining means are provided for alternately disposing the chair between an upright seating position and a full recline position. Synchronous-belt extension mechanisms are provided for extending the legrest and footrest in relation to the degree of recline, the legrest extending with moderate recline and the footrest extending as full recline is approached. In the full upright position, the leg support portions are retracted in a tuck position beneath the seat portion. One embodiment of the invention includes a passive-active height adjust mechanism.

BRIEF DESCRIPTION OF THE DRAWINGS

The invention will be described in greater detail below by way of reference to the following drawings, in which.

DETAILED DESCRIPTION OF THE DRAWINGS

Figure 1:
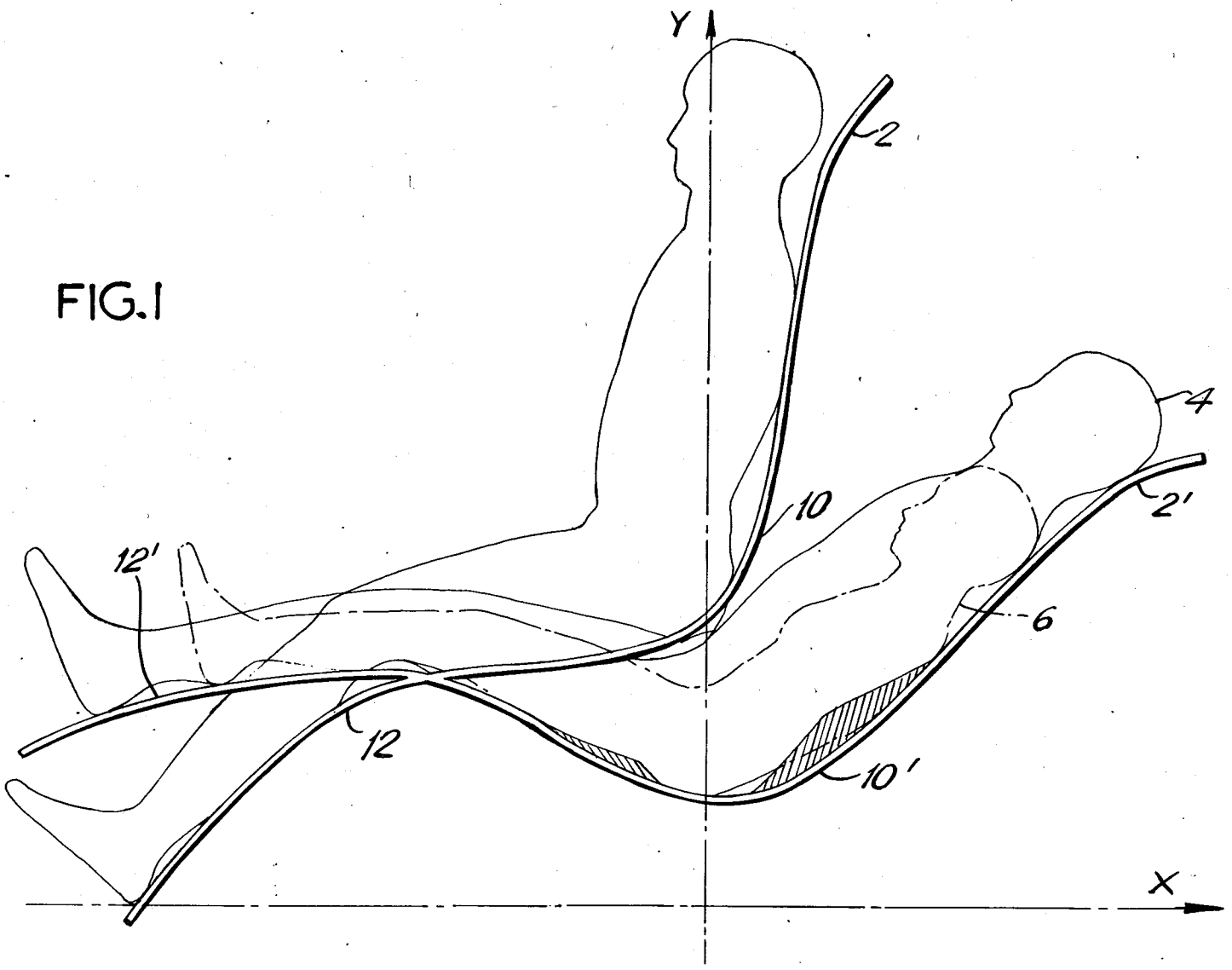
FIG. 1 is an illustration of an open-angle seating concept otherwise known as the "Golden Curve"

FIG. 1 illustrates the aforementioned open-angle seating "Golden curve" concept. More particularly, FIG. 1 illustrates the Golden curve shown in an upright orientation 2 and in a recline orientation 2'. The curve itself is continuous and includes a first concave segment 10, 10' and a second convex segment 12, 12'.

Also illustrated in FIG. 1 are caricatures of a large male 4 and a small female 6 shown in a seating attitude as they would in an apparatus embodying the Golden curve. Thus, it may be seen that when the male 4 and female 6 are seated in an apparatus embodying the Golden curve in a recline attitude 2', the buttocks of the male and female would rest in the concave segment 10' of the curve and their legs would be supported by the convex segment 12' of the curve.

Note that, as the curve is transposed from upright mode 2 to recline mode 2', the legs of the occupant are elevated in height (increasing Y values) while the buttocks are lowered (decreasing Y values). Note further that, with recline, there is likewise a displacement of the occupant's upper body in the rearward direction (increasing X values). Thus it may be seen that when the full recline attitude has been achieved, the legs of the occupant in an apparatus embodying the Golden curve are supported by a convex curve having its apex in a higher horizontal plane than the plane of the base of the concave curve which supports the buttocks and back portions of the reclining occupant. Such a reclining orientation has been empirically demonstrated to result in greater relaxation and less stress than standard, fully upright seating attitudes and other known reclining attitudes. Additionally, it has been demonstrated that the Golden curve seating orientation results in decreased rate of heart-beat and more relaxed breathing patterns.

While substantially the full length of the Golden curve is put to use by the large male 4 when the curve is in the recline attitude 2', the thigh and lower leg support function provided by the convex portion 12 of the curve interferes with the vertical movement of the man's legs in the upright attitude 2.

The instant invention provides for the first time an apparatus, a chair, which embodies the Golden curve seating concept (providing the aforementioned less stressful, more relaxed seating attitude when the chair is in the recline mode) while being fully functional in an upright mode.

Figure 2A:
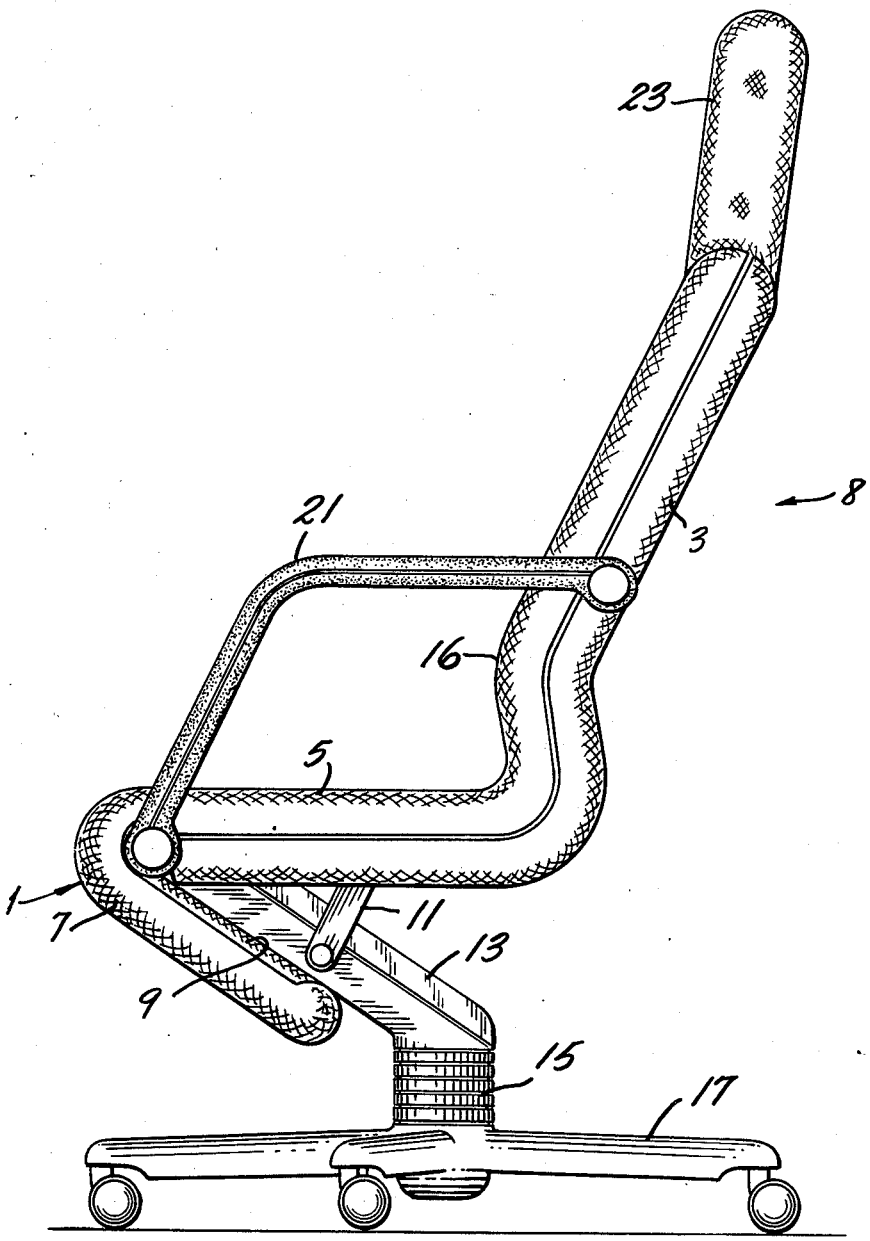
FIG. 2A is an elevation of an uphostered chair according to the invention shown in a full upright orientation ("Position I")

One embodiment of a chair in accordance with the invention is illustrated in the drawings of FIGS. 2A–2D. FIG. 2A illustrates an uphostered chair 8 according to the invention in a full upright orientation ("Position I"). The embodiment illustrated in FIG. 2A includes a back portion 3, a seat pan 5, and a leg support portion 1 including a legrest 7 and a footrest 9. The back portion 3 and the seat pan 5 may collectively referred to as a seat shell 19 and may be fabricated as a single unit. In the fully upright orientation ("Position I") illustrated in FIG. 2A, the legrest portion 7 and footrest portion 9 are retracted in a tuck position beneath the seat portion 5.

Figure 2B:
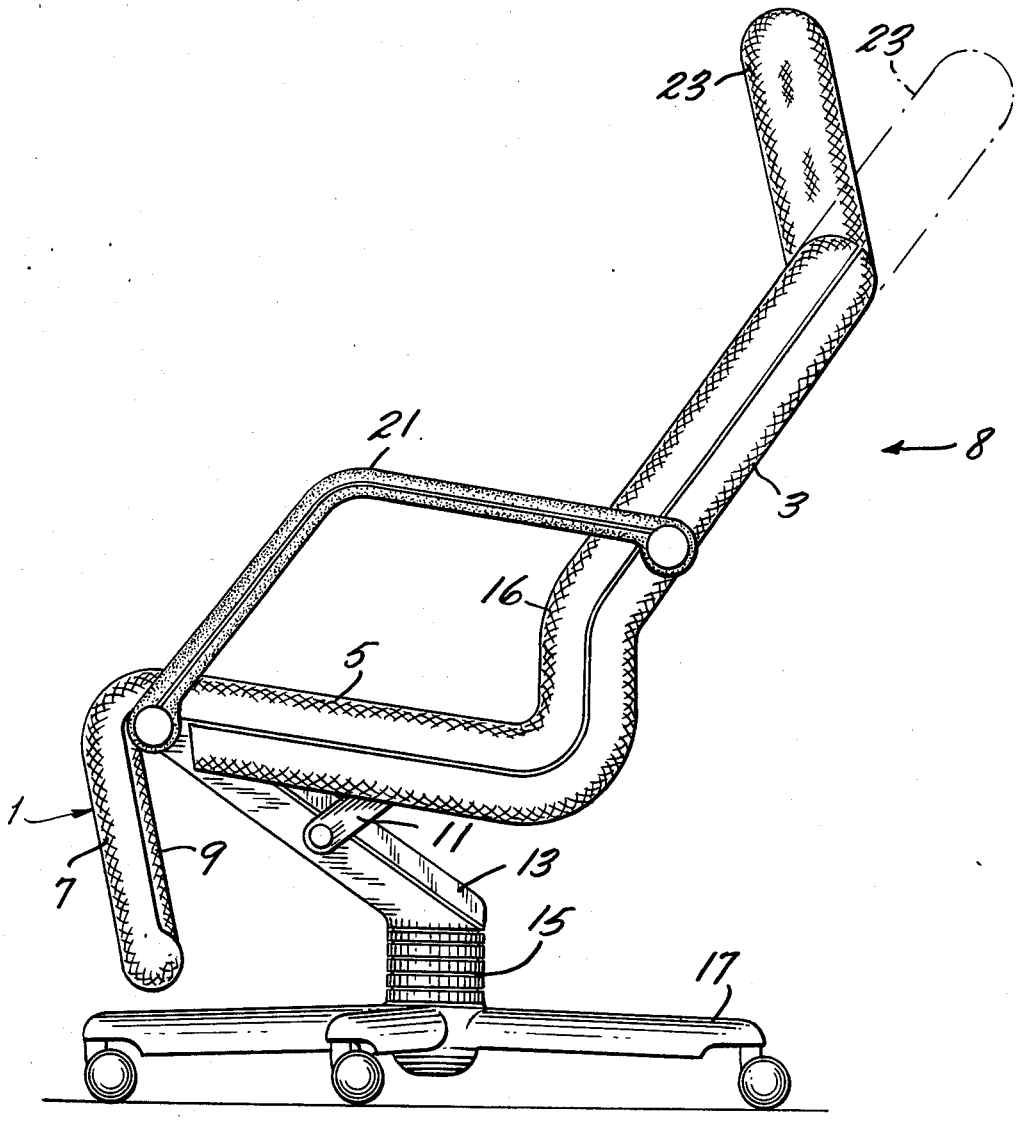
FIG. 2B is an elevation of a chair according to the invention shown in a first intermediate recline orientation ("Position II") wherein the legrest is becoming extended.

FIG. 2B illustrates the chair 8 of FIG. 2A in a first intermediate recline orientation, hereinafter referred to as "Position II." In Position II, the chair 8 is partially reclined to a point where gearing mechanisms (explained in greater detail below) cause the leg support portion 1 to begin extending. Since recline in Position II is slight, no significant leg support is needed, thus the footrest portion 9 remains retracted beneath the chair seat 5.

FIG. 2B also illustrates an adjustable headrest which may be incorporated in a chair according to the invention to provide head support which the occupant can adjust according to the degree of recline, if desired. Known adjusting means which may be used to link the headrest and the chair back 3 include a rachet mechanism (not shown). The headrest may be incrementally or infinitely adjustable.

Figure 2C:
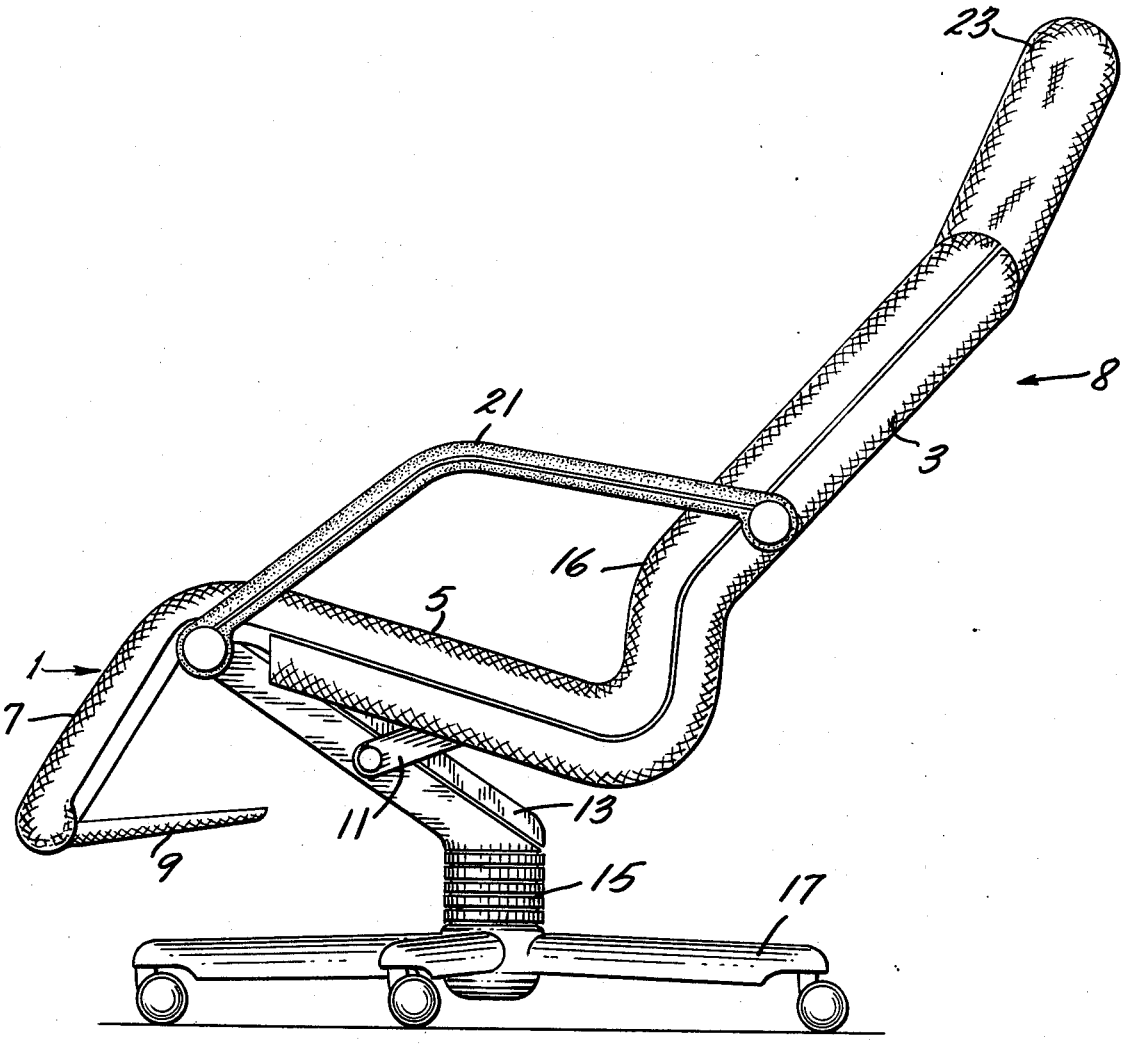
FIG. 2C is an elevation of a chair according to the invention in a second intermediate recline orientation ("Position III") wherein the footrest is becoming extended.

FIG. 2C illustrates the chair 8 in a second intermediate recline orientation ("Position III") wherein the legrest portion 7 is becoming more fully extend relative to the greater degree of recline. Additionally, in Position III, the footrest portion 9 has begun to become extended. In Position III, the chair 8 provides substantial leg support, but since recline is still intermediate, foot support is not provided.

Figure 2D:
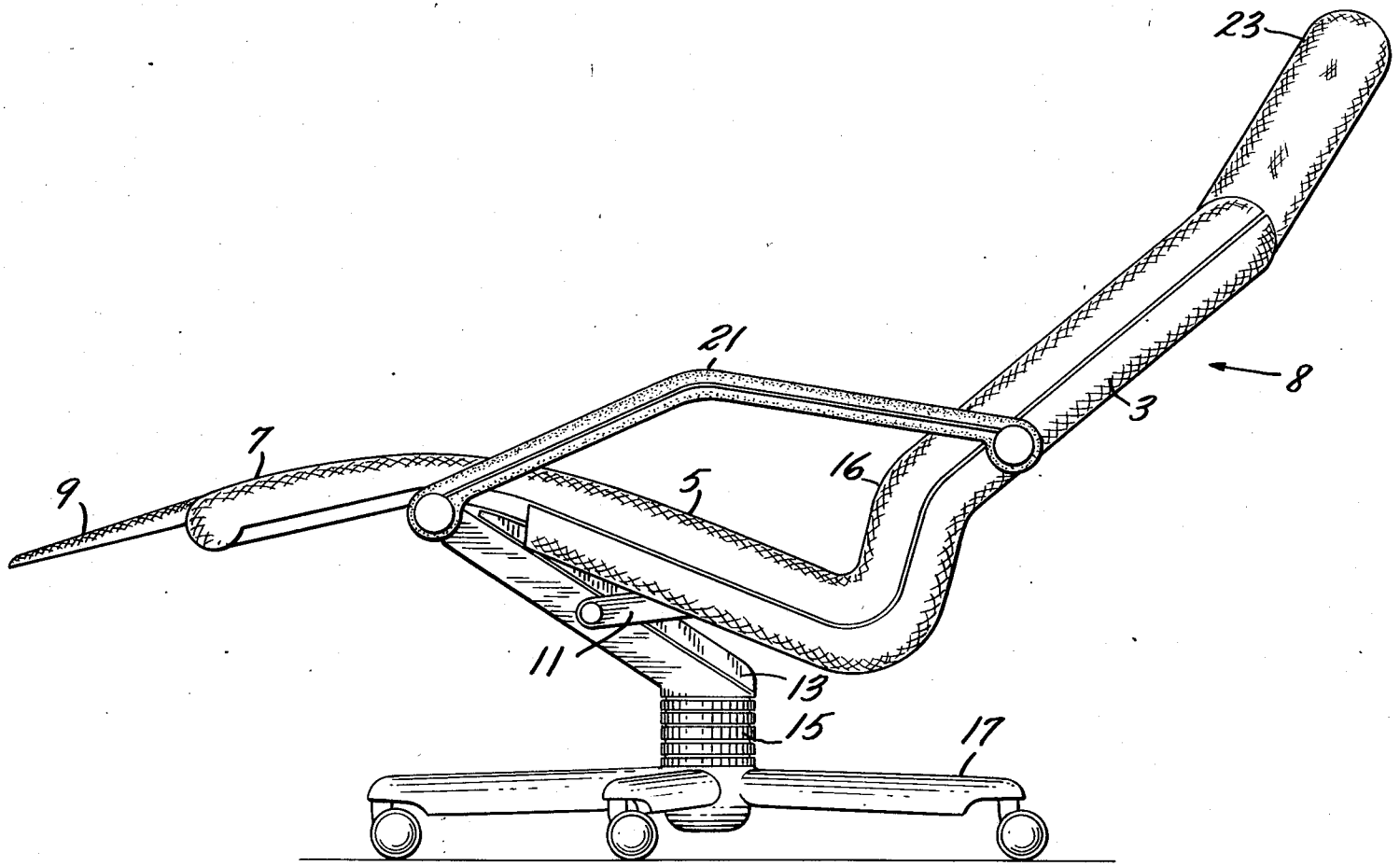
FIG. 2D is an illustration of a chair according to the invention shown in a full recline orientation ("Position IV") wherein the footrest and legrest are fully extended, the chair in this orientation embodying a Golden curve.

FIG. 2D illustrates the chair 8 of the invention in a full recline orientation ("Position IV") wherein the footrest portion 9 has fully extended to provide foot support in addition to the leg support provided by legrest portion 7. Position IV embodies the Golden curve concept discussed above with regards to FIG. 1.

Figure 4:
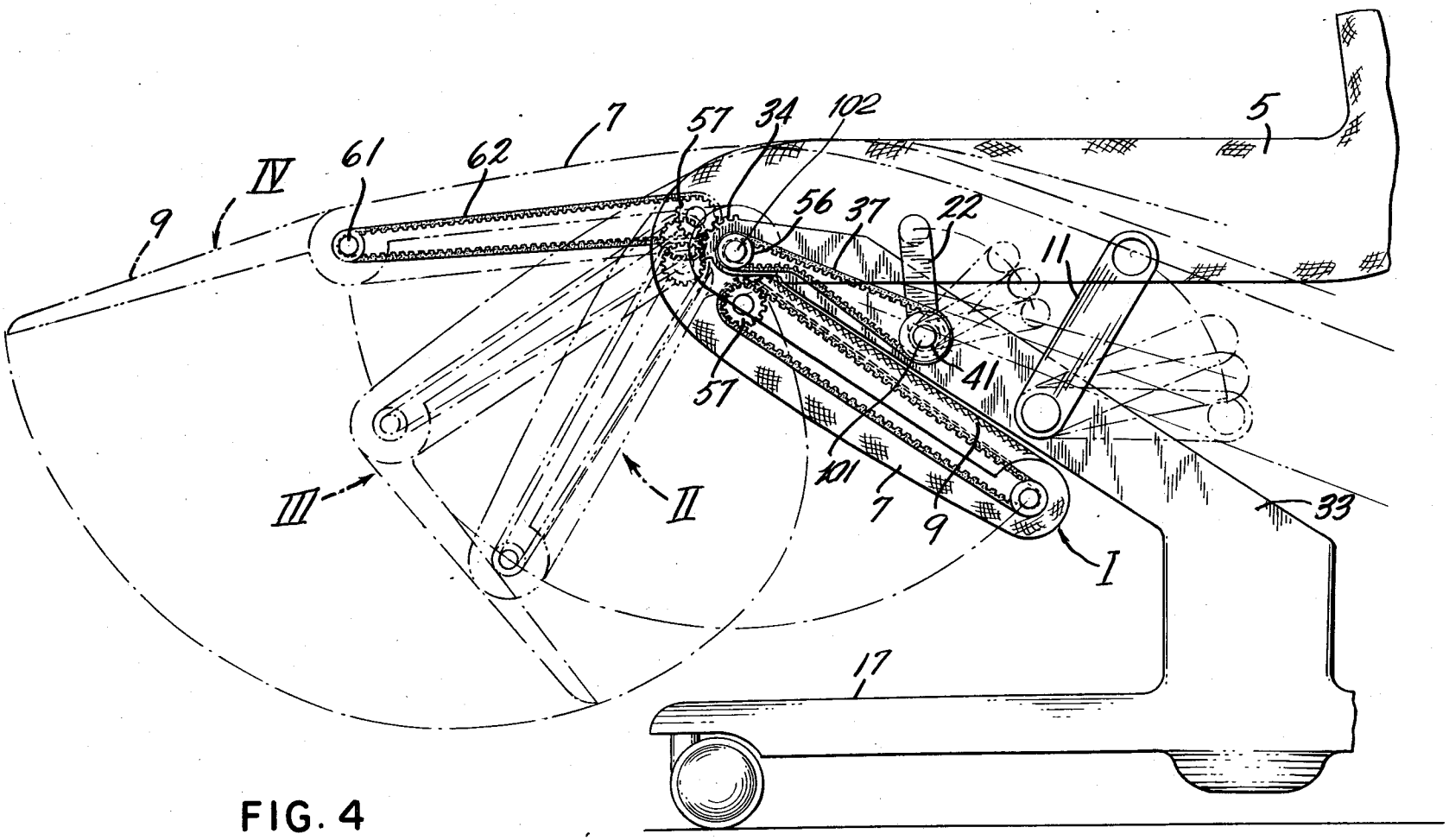
FIG. 4 is a cross-sectional illustration of the dual-pivoting recling means and the synchronous-belt leg support extension mechanisms of a chair in accordance with the instant invention, showing leg support extension relative to the degree of recline.

Also illustrated in the embodiment of FIGS. 2A–2D are a side arm 21 fixed from the approximate mid-point of the back portion 3 through a slightly obtuse curve to the leaving edge of the seat portion 5; a central support shaft 15 which may include a passive-active height adjustment mechanism (see FIG. 5); a cross-bar support and extension housing 13 fixed from the central shaft 15 to the forward edge of the chair seat portion 5; and a pivoting bell crank 11, the pivoting function of which is illustrated in FIG. 4. Also illustrated in the drawings of FIGS. 2A–2D is a chair base 17 for dispersing the weight load and casters 19 for transporting the chair. Lumbar support 16 may likewise be provided.

Figure 3:
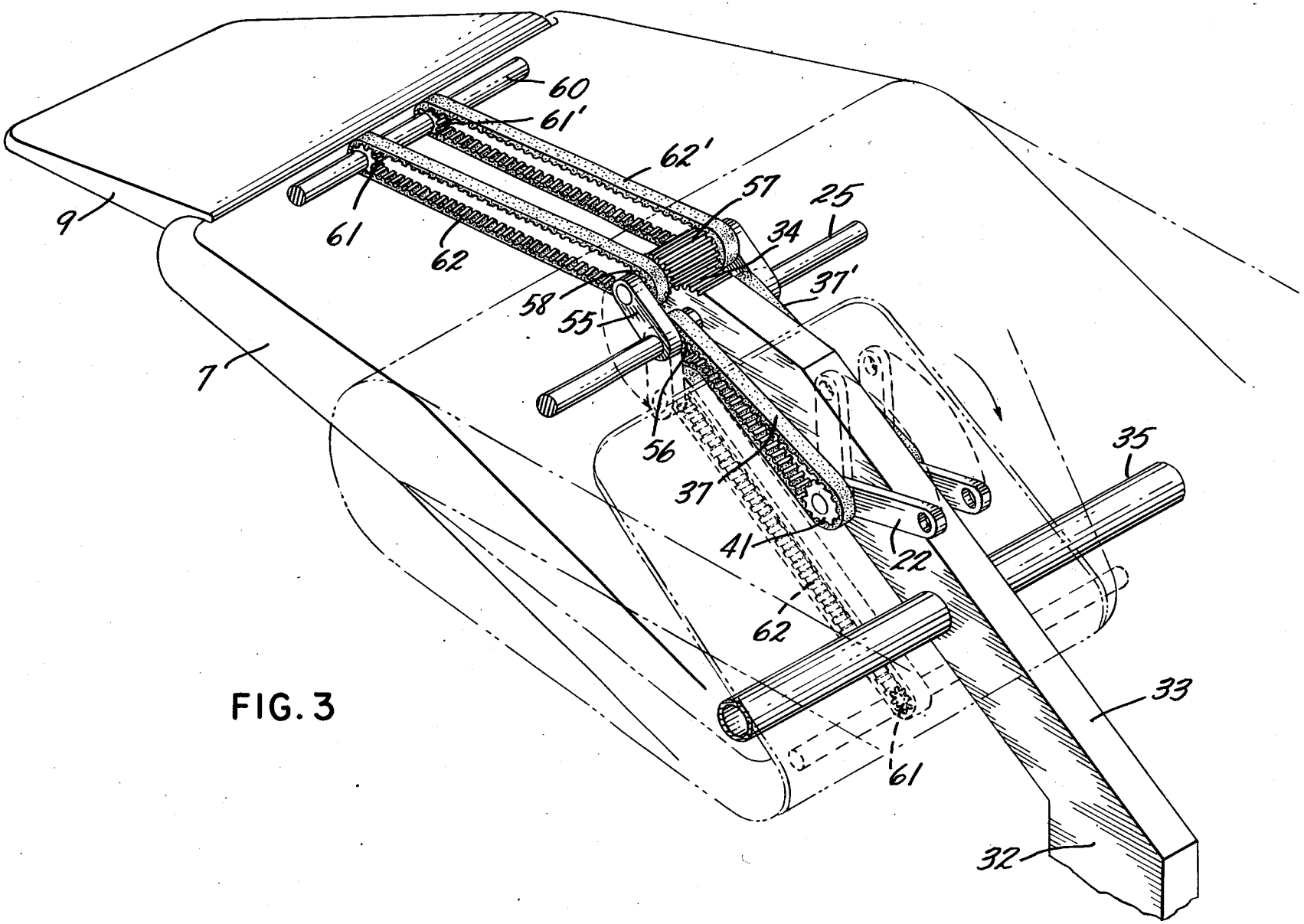
FIG. 3 is a perspective drawing of a synchronous-belt drive mechanism for effecting leg support extension and retraction relative to degree of recline in an apparatus in accordance with the instant invention.

A mechanism for providing extension of the leg support portion 1 relative to the degree of recline in an apparatus according to the invention will now be described by way of reference to FIG. 3. FIG. 3 illustrates a vertical support shaft 32 which, in a preferred embodiment, is retained within housing 13 (FIG. 2A). The vertical support 32 supportably connects the upper portion of the chair to the base 17. Vertical support shaft 32 continues at its upper end to either be integrally connected with or otherwise joined to diagonal support 33.

Perpendicularly provided approximately one-third the way up the diagonal support 33 is a horizontal cross-pipe 35, defining a pivot point for the lower pivoting bell crank 11 of FIG. 2A. Pivoting bell crank 11 may thus be secured along diagonal support 35. Approximately one-third the way down from the top of diagonal support 33 is provided a bell crank 22 pivotally secured at its sprocket end through the diagonal support 33. At this pivot point, toothed circular drive gears 41 which may be a 1/5 pitch (16 tooth) timing pulley is coupled to the sprockets of the bell crank 22.

A fixed horizontal support pipe 25 is provided at the upper end of diagonal support 33, parallel to the lower cross pipe 35. Pivotally connected along horizontal pipe 25 are the drive portions of bell crank 55. Centered between the bell crank 55, along upper horizontal pipe 25, is the upper end of the diagonal support 33. The upper end of the support 33 is provided with a gear segment 34. Substantially between the end of diagonal support 33 and the drive end of bell crank 55, along upper horizontal pipe 25, are provided toothed circular drive gears 56 which may be a 1/5 pitch 10 tooth timing pulley.

A pair of endless timing belts 37, 37' circulate about timing pulley 56 of bell crank 55 and the driven gears 41 at bell crank 22.

A cylindrical drive gear 57 is provided between the corresponding drive ends of bell crank 55. The cylindrical drive gear 57 is provided to mesh with the gear segment 34 provided at the end of diagonal support 33. A 14-tooth (1/5 pitch) timing pulley 58 may be provided between bell crank 55 and drive gear 57 about the center of rotation thereof.

A third horizontal cross pipe 60 is fixed at the forward end of legrest 7 near junction between footrest 9 and legrest 7. Circular gear teeth 61, 61' which may be 10 tooth at 1/5 pitch timing pulleys are provided circumferencially about the cross pipe 60 at positions towards the center of pipe 60 but spaced apart. Gear teeth 61, 61' rotate freely about horizontal support pipe 60. A second pair of parallel timing belts 62, 62' is provided circulating about opposite ends of cylindrical gear 57 and the spaced, parallel gear teeth 61, 61' of forward support pipe 60.

Horizontal support pipes 25 and 60 are parallel with all pivot points thereon rotating freely.

In operation, as the seat 5 (FIG. 4) reclines (e.g. by the action of an occupant sitting therein), the bell crank 22 rotates in the direction of the arrow in FIG. 3 activating the first timing belts 37, 37'. The first timing belts 37, 37' drive the legrest portion 7 through, for example, 139 degrees of rotation as it pivots about pipe 25. When the legrest portion 7 rotates 84 degrees of the 139 degrees, cylindrical drive gear 57 engages drive gear segment 34 of support 33 and activates second timing belts 62, 62'. Second timing belts 62, 62' then engage gears 61, 61' to drive the footrest portion 9 through, for example, 167 degrees of rotation. It is at this point that the footrest portion 9 becomes fully extended as illustrated in the drawing of FIG. 2D.

Skeletal support members (not shown) may be fixedly secured to upper horizontal support pipe 25 for providing structural support to the legrest 7. Further skeletal support members (not shown) may be fixedly secured to the forward horizontal support pipe 60 to provide structural support for the footrest 9.

FIG. 4 illustrates the actuation of the timing mechanism of the invention in relation to recline of the seat shell 19 (FIG. 2A), the seat shell comprising seat portion 5 and back portion 3 (not shown in FIG. 4). The positions indicated by I, II, III, and IV in FIG. 4 correspond to Positions I–IV illustrated in FIGS. 2A–2D.

As illustrated in FIG. 4, as bell crank 22 is activated by reclining of the seat shell including seat portion 5 and rotates 84 degrees about pivot center 101, the rotation of bell crank 22 drives 1/5 pitch (16 tooth) timing pulley 41 which operates the first timing belt 37. The first timing belt 37 drives the 1/5 pitch 10 tooth timing pulley 56 at pivot point 102 rotating the legrest portion 7 through 139 degrees of travel. (Position II). At 84 degrees through the clockwise rotation of the legrest 7, drive gear 57 engages gear segment 34 driving, for example, 1/5 pitch (14 tooth) timing sprocket 58 (See FIG. 3) engaging second belt drives 62, 62'. (Position III). As the legrest 7 completes its remaining 55 degrees of rotation, sprocket 58 moves the timing pulley 61 through 167 degrees of movement. This latter operation drives footrest 9 to full extension. (Position IV).

By similar reverse operation, the legrest portion 7 and the footrest portion 9 are retracted and returned to the stowed position (Position I) by returning the seat shell including seat 5 to its upright position.

As shown in FIG. 4, both cranks 22 and 11 pivot in relation to the degree of recline of the seat shell 5. The forward crank 22, which inclines forward when the seat shell 5 is upright, is shorter in length than the rearward crank 11 which inclines backwards when the seat shell is upright. As is apparent from FIG. 4, the relative lengths and upright orientations of the cranks 11 and 22 are such that crank 22 traverses a greater degree (arc) of pivot than crank 11, enabling the provision of additional drive to belt 37. This orientation may additionally serve to provide a relatively deeper recline of the rearward part of the seat shell 5 as is shown in FIG. 4 by comparing the paths of cranks 11 and 22.

Note that no manual intervention is required in the illustrated embodiment and that acuation of the timing belts 37, 62 though bell crank 22 and the intervening gears may be accomplished through shifting the center of gravity with respect to vertical center line through base 15 (line Y, FIG. 1). However, more elaborate embodiments are easily contemplated wherein heavy upholstering and other details would add significant weight to the chair thereby requiring more energy to be applied, for example, to restore the chair from its full recline Position IV (FIG. 20) to its full upright Position I (FIG. 2A). In such embodiments, manual, or hydraulic or electric motor drives may be provided to assist in restoring or reclining the chair to a desired position.

Indeed, in some embodiments the weight of the chair may render impracticable the caster-driven base of FIGS. 2A–2D. In such embodiments, fixed position or motor driven chair bases may be provided.

It should be noted that either infinitely or incrementally adjustable friction locks may be provided about pivot points defined by horizontal pipes 25, 35 and 60 to allow either infinitely or incrementally adjustable recline.

Figure 5:
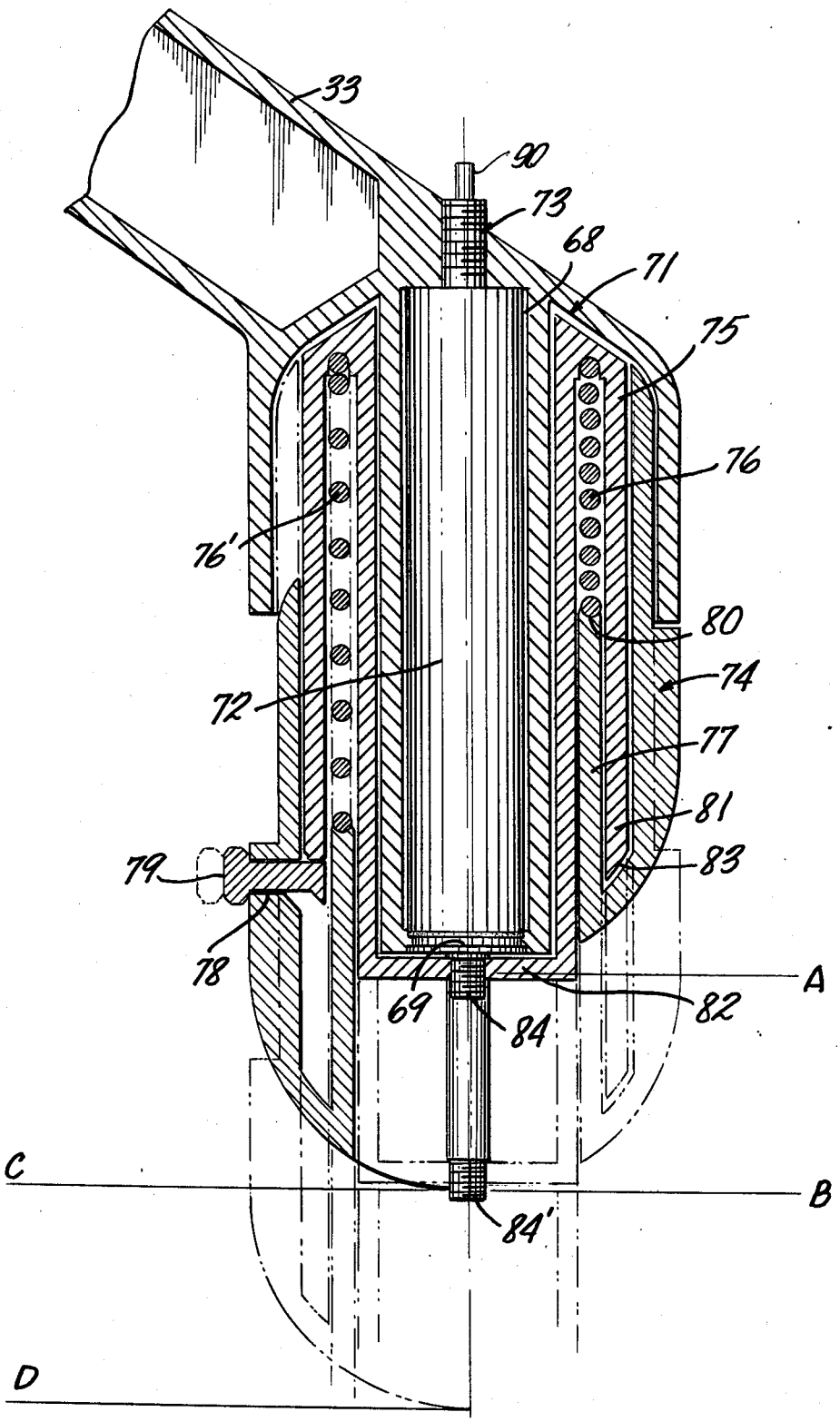
FIG. 5 is a cross-sectional illustration of a passive-active height adjustment for a chair in accordance with the invention.

FIG. 5 illustrates a passive-active height adjustment mechanism which may be provided within vertical support 15 (FIG. 2A) to allow for various stages of height adjustment in a chair according to the invention.

As illustrated in FIG. 5, the diagonal support 33 may terminate as a cylindrical yoke 71 adapted to receive a compression extension means such as compressed gas cylinder 72 (SUSPA #18-1-046) having fixed stem 73 threaded through yoke 71. The cylinder 72 may be retained within a hollow 68 defined within yoke 71 and may be secured within a hollow 68 within cylinder cap 69. Cylindrical base 74 is configured as an inverse of yoke 71 and is thereby adapted to slideably engage within hollow interior channels of yoke 71 and to slideably engulf gas cylinder 72. Base 74 may be fixed or otherwise secured to weight dispersing base 17 within support frame 15 (FIG. 2A).

Vertically disposed between the downward facing yoke 71 (FIG. 5) and the upward facing cup-shaped base 74 is an elastic means such as a spring carrier 75 including a spring 76, 76' shown in a compressed state 76 and an extended state 76'. A vertically cylindrical spring compressing component 77 of base 74 rests within the interior of spring carrier 75 and serves to compress the spring which is disposed vertically above and in line with the compressor 77 within the carrier 75.

An appropriate surface 80 may be provided at the upper edge of the compressor 77 to allow the spring 76 to rest securely.

Spring carrier 75 includes outer shell 81 which terminates at a beveled tip 83 and an internal cup 82 wherein both yoke 71 and gas cylinder 72 are retained, the extending stem 84 of gas cylinder 72 being threadablely retained within cup portion 82 of spring carrier 75 such that when stem 84 is extended and/or retracted by the actuation of the release button 90 of gas cylinder 72, spring carrier 75 is urged to follow accordingly.

A lock 79 is provided within cup-base 74 through an aperture 78. Lock 79 is horizontally engageable/disengageable to retain spring carrier 75 in either a higher or lower configuration with respect to the base 74, the higher configuration (spring compressed 76) being achieved with the lock 79 disengaged and the lower configuration (spring extended 76') being achieved with the lock engaged.

At least four basic levels of height support are provided with the height adjustment mechanism of FIG. 5 with infinite adjustments therebetween achievable through the operation of the gas cylinder 72. Elevations A and B illustrate configurations wherein the lock 79 is disengaged, allowing the spring carrier to fall with respect to the yoke 71 as piston stem 84 is extended. At elevation A, the cylinder 72 is compressed. At elevation B the cylinder stem 84 is extended.

Elevations C and D illustrate configurations wherein the lock 79 is engaged, and the spring carrier 75 is retained in an upper orientation with respect to base 74. Elevation C illustrates a configuration where the cylinder stem 84 is compressed and elevation D illustrates a configuration where the cylinder stem 84 is extended.

Thus, with a passive-active height adjustment mechanism according to FIG. 5, a chair may be provided varying degrees of height adjustment.

Although specific features of an embodiment of the invention have been presented in detail herein, it should be understood that a wide variety of embodiments may be provided within the spirit of the invention. Particularly, a wide variety of chairs are contemplated, in addition to office chairs, incorporating the belt-drive retraction mechanisms and passive-active height adjustment mechanisms of the invention. Additionally, although it is preferred that a chair according to the invention provide a "Golden" curve in a reclining mode, other types of reclining curves may be provided within the invention.

Other types of mechanical interfaces than those shown are likewise contemplated for inclusion within the scope of the invention.

It should be clear, therefore, that the invention is not limited to the specific embodiments disclosed herein, but should be interpreted only in accordance with the spirit and scope of the claims which follow.

We claim:

1. A reclining chair, comprising:

a seat shell having a seating portion and a back portion;

seat support means for supporting said seat shell at an elevation, said seat support means having a diagonal component extending upwards beneath said seat shell towards a forward edge of said seat shell and forming an acute angle therewith;

first crank means, secured at an upper end about a first point on the seating portion of said seat shell and pivotally secured at a lower end to a first pivot point located on said diagonal component;

said seat shell being disposable in degrees of recline between an upright orientation and a full recline orientation relative to said seat support means, said crank means pivoting about said first pivot point in degrees relative to the degree of recline of said seat shell;

a leg support portion rotatably extendable in degrees about the forward edge of said seat shell, wherein said leg support portion includes a legrest and a footrest, said footrest being rotatably extendable in degrees about a forward edge of said legrest, a second pivot point being provided substantially about a rearward edge of said leg support portion and in proximity to the forward edge of said seat shell, said leg support portion pivoting about said second pivot point;

first belt drive means including a first endless belt revolving about said lower end of said first crank means and said second pivot point, drivingly pivoting said leg support portion in degrees about said second pivot point in response to the pivoting of said crank means and relative to the degree of pivot of said crank means and thereby rotatably extending said leg support portion about the forward edge of said seat shell, said first crank means driving said first endless belt;

second belt drive means including a second endless belt revolving between a point located substantially about the rearward edge of said legrest and a third pivot point provided substantially about a rearward edge of said footrest for drivingly pivoting said footrest in degrees about said third pivot point and thereby rotatably extending said footrest about said forward edge of said legrest; and belt drive engagement means cooperating with said first and second belt drive means for engaging said second endless belt relative to the degree of pivot of said first crank means and the resultant revolving of said first endless belt.

2. A reclining chair, as recited in claim 1, wherein said belt drive engagement means comprises a gear segment provided at an upper end of said diagonal component, a drive gear in engagement with said second belt drive means for driving said second belt drive means, and second crank means having one end pivotally secured about said second pivot point and another end secured to said drive gear means, said second crank means pivoting about said second pivot point relative to the degree of pivot of said first crank means and the resultant revolving of said first endless belt such that upon substantial pivot of said first crank means and revolving of said first belt, said second crank means carries said drive gear into engagement with said gear segment, actuating said second belt drive causing said second belt to revolve and to thereby pivot said footrest and rotatably extend same.

3. A reclining chair, as recited in claim 1, wherein said back portion and said seating portion form a substantially continuous concave curve, said chair being further adapted such that when said seat shell is in said upright orientation, said footrest and said legrest are retained in a tuck position beneath said seat shell; when said seat shell is in an intermediate degree of recline, said legrest is extended forming a substantially continuous convex curve with the seating portion of said seat shell; and when said seat shell is in said full recline orientation, said legrest and said footrest are extended forming a substantially continuous convex curve having its apex in a higher horizontal plane than the plane of the base of the concave curve formed by said back portion and said seating portion.

4. A reclining chair, as recited in claim 1, further comprising:

further crank means, pviotally secured at a lower end to a further pivot point located on said diagonal component at a position beneath said seating portion to the rear of said first pivot point, and at an upper end to a second point on said seating portion between said first point on said seating portion and said back portion, said further crank means pivoting about said further pivot point in degrees relative to the degree of recline of said seat shell; said first crank means being shorter in length than said further crank means; and said first and further crank means being arranged such that when said seat shell is in said upright orientation, said first crank means inclines forwards and said further crank means inclines backwards.

* * * * *